US007137159B1

(12) United States Patent
Choate

(10) Patent No.: US 7,137,159 B1
(45) Date of Patent: Nov. 21, 2006

(54) BEDCLOTHES SUPPORT ASSEMBLY

(76) Inventor: Christe W. Choate, 9600 W. 96th St., Sapulpa, OK (US) 74066

( * ) Notice: Subject to any disclaimer, the term of this patent is extended or adjusted under 35 U.S.C. 154(b) by 0 days.

(21) Appl. No.: 10/685,107

(22) Filed: Oct. 14, 2003

(51) Int. Cl.
*A47C 21/02* (2006.01)

(52) U.S. Cl. ..... 5/505.1; 5/504.1

(58) Field of Classification Search ..... 5/505.1, 5/504.1, 503.1, 658, 659
See application file for complete search history.

(56) References Cited

U.S. PATENT DOCUMENTS

| | | | | | |
|---|---|---|---|---|---|
| 802,610 | A | * | 10/1905 | Tuttle | 5/505.1 |
| 998,996 | A | * | 7/1911 | Swenson et al. | 5/634 |
| 1,175,526 | A | * | 3/1916 | Jones | 5/505.1 |
| 1,577,089 | A | * | 3/1926 | Whitford | 5/505.1 |
| 1,577,825 | A | * | 3/1926 | Jenness | 5/648 |
| 1,741,361 | A | * | 12/1929 | Doyle | 5/505.1 |
| 2,106,834 | A | * | 2/1938 | Ewald | 5/505.1 |
| 2,112,122 | A | * | 3/1938 | Sullivan | 5/505.1 |
| 2,210,255 | A | * | 8/1940 | Peevey | 5/505.1 |
| 2,235,191 | A | * | 3/1941 | Arnould | 5/505.1 |
| 2,244,310 | A | * | 6/1941 | Murphy | 5/690 |
| 2,291,203 | A | * | 7/1942 | Bent | 5/505.1 |
| 2,300,898 | A | * | 11/1942 | Allen | 5/505.1 |
| 2,401,999 | A | * | 6/1946 | Wolfe | 5/505.1 |
| 2,598,295 | A | * | 5/1952 | Pelton | 5/505.1 |
| 2,602,171 | A | * | 7/1952 | Good | 5/505.1 |
| 2,611,139 | A | * | 9/1952 | Ecklund | 5/505.1 |
| 2,642,589 | A | * | 6/1953 | Cobb | 5/505.1 |
| 2,668,963 | A | * | 2/1954 | Drake | 5/505.1 |
| 3,317,932 | A | * | 5/1967 | Gibbons, Sr. | 5/505.1 |
| 3,713,182 | A | * | 1/1973 | McNeal | 5/421 |
| 3,808,614 | A | * | 5/1974 | Reinhard | 5/505.1 |
| 4,287,622 | A | * | 9/1981 | Lane | 5/505.1 |
| 4,561,549 | A | * | 12/1985 | Yokohori | 211/182 |
| 4,841,589 | A | * | 6/1989 | Moore | 5/505.1 |
| 5,329,658 | A | * | 7/1994 | Fontenot et al. | 5/505.1 |
| 5,438,720 | A | * | 8/1995 | Daneshvar | 5/505.1 |
| 5,881,406 | A | * | 3/1999 | Cobb | 5/505.1 |
| 6,834,403 | B1 | * | 12/2004 | Elliott | 5/505.1 |
| 6,895,615 | B1 | * | 5/2005 | Dilascio | 5/505.1 |
| 6,901,616 | B1 | * | 6/2005 | Warrington et al. | 5/505.1 |
| 2003/0229942 | A1 | * | 12/2003 | Dilascio | 5/505.1 |
| 2005/0273931 | A1 | * | 12/2005 | Edwards | 5/505.1 |

FOREIGN PATENT DOCUMENTS

| | | | | | |
|---|---|---|---|---|---|
| CA | 497849 | A | * | 11/1953 | 5/505.1 |
| CH | 129245 | B | * | 12/1928 | 5/505.1 |
| CH | 182528 | B | * | 5/1936 | 5/505.1 |
| FR | 999265 | A | * | 1/1952 | 5/505.1 |
| GB | 998 | A | * | 3/1880 | 5/505.1 |
| GB | 229146 | A | * | 2/1925 | 5/505.1 |
| GB | 2044087 | A | * | 10/1980 | |
| NL | 7600788 | B | * | 7/1977 | |

* cited by examiner

*Primary Examiner*—Robert G. Santos
(74) *Attorney, Agent, or Firm*—Frank J. Catalano

(57) ABSTRACT

A bedclothes support assembly maintains bedclothes in an elevated condition over the feet or other part of a person's anatomy. An upper member which extends across the mattress is supported at both ends above the selected part of the anatomy by upright members whose lower ends are supported by one of a variety of structures. The supporting structure may, for example, be a horizontal tongue extending from a horizontal member and abutting against the lower surface of the mattress, a floor mounted base or tubular cross-members with lengthwise slots for engagement on the frame of the bed. The upper horizontal member supports the bedclothes high enough to provide clearance between the bedclothes and the mattress for the selected portions of the anatomy.

12 Claims, 5 Drawing Sheets

BEDCLOTHES SUPPORT ASSEMBLY

BACKGROUND OF THE INVENTION

This invention relates generally to care for bedfast patients and more particularly concerns an assembly for supporting the bedclothes of patients restricted to a bed, whether in a hospital, a nursing home or an in-home environment.

There is presently available a device known as a "foot cradle" used to support bedclothes above the feet of bedfast patients, such as patients suffering as a result of gangrenous toes, decubitus, hip and knee repair and replacement, traction, casting, stroke, paralysis, back injuries and so on. The "foot cradle" has a C-shaped base that slides between the bed frame and the mattress, a post extending upwardly from one end of the base at the side of the mattress and a cross-member extending horizontally from the top of the post above and over the base. The base is intended to support the post and cross-member in their vertical and horizontal alignments while the cross-member extends under the bedclothes and supports the bedclothes above the feet of the patient. However, the weight of the bedclothes and incidental external forces exerted on the assembly are transferred by the cross-member and post to one point on the base, tending to produce torque on the base. The torque produced is frequently sufficient to overcome the resistance afforded by the weight of the mattress on the base so that the assembly will tip, allowing the bedclothes to lower onto the feet of the patient. Sometimes, the assembly itself will fall onto the patient. The torque problems are exacerbated because the post supports only one end of the cross-member. As a result, the free end of the cross-member tends to dip downwardly under the weight of the bedclothes and the C-shaped base is inadequate to maintain the vertical orientation of the post. Furthermore, the flexibility of the post and cross-member also allow the unsupported end of the cross-member to dip downwardly under the weight of the bedclothes. The tendencies to tip and deflect further weaken the stability of the assembly and accentuate the impact of any forces that may be applied to the bedclothes or the assembly by the patient or others. Consequently "foot cradles," even when at hand, are generally not used by immediate care givers and merely take up valuable space in the care-giving area. This is unfortunate because supporting bedclothes above the patient's feet and creating a space around the patient's feet for circulation of air would be helpful to keep the skin clean and dry and to prevent bed linens from further irritating skin that is already compromised.

It is, therefore, an object of this invention to provide a bedclothes support assembly which is stable under the weight of the bedclothes. Another object of this invention is to provide a bedclothes support assembly which is easily mountable in relation to a bed. A further object of this invention is to provide a bedclothes support assembly which has components not easily deflected by the weight of the bedclothes. Yet another object of this invention is to provide a bedclothes support assembly which supports bedclothes from both sides of the bed. It is also an object of this invention to provide a bedclothes support assembly which resists tipping as a result of torque applied by the covers.

SUMMARY OF THE INVENTION

In accordance with the invention a bedclothes support assembly is provided which maintains bedclothes in an elevated condition to protect the feet or other selected portion of a person's anatomy. An upper member is of length at least equal to the width of the mattress of the bed. A pair of upright members are of equal height substantially greater than the distance from the lower surface of the mattress to the uppermost point of the part of the anatomy to be protected. The upper ends of each of the upright members are attached to the ends of the upper horizontal member. The lower ends of each of the upright members are supported at the same elevation which is at least equal to the elevation of the mattress. The upper horizontal member supports the covers and the upright members hold the upper horizontal member at an elevation sufficient to provide clearance between the cover and the mattress for protection of the selected portions of the anatomy. The upper horizontal member and the upright members are sufficiently rigid to substantially prevent deflection of these members by the weight of the covers on the upper horizontal member.

In a first embodiment, the upright members are supported in their vertical condition by a lower horizontal member attached between the lower ends of the upright members and disposed under the mattress. A horizontal tongue extends from the lower horizontal member for abutment against the lower surface of the mattress. In a second embodiment, the upright members are supported by a floor mounted base. For example, two pairs of legs may be connected to a downward extension of each of the upright members by use of horizontal cross-members which are substantially transverse to the upper horizontal member.

In a third embodiment, the upright members are supported by two tubular cross-members substantially transverse to the upper horizontal member. One cross-member is fixed to the lower end of each of the upright members. Each cross-member has a lengthwise slot in a wall thereof for engagement on the frame of the bed. The slots may be in horizontally diametric outside walls of the tubular members for engagement on a frame with horizontal flanges or in vertically diametric lower walls of the tubular members for engagement on a frame with vertical flanges.

BRIEF DESCRIPTION OF THE DRAWINGS

Other objects and advantages of the invention will become apparent upon reading the following detailed description and upon reference to the drawings in which.

Figure 2:
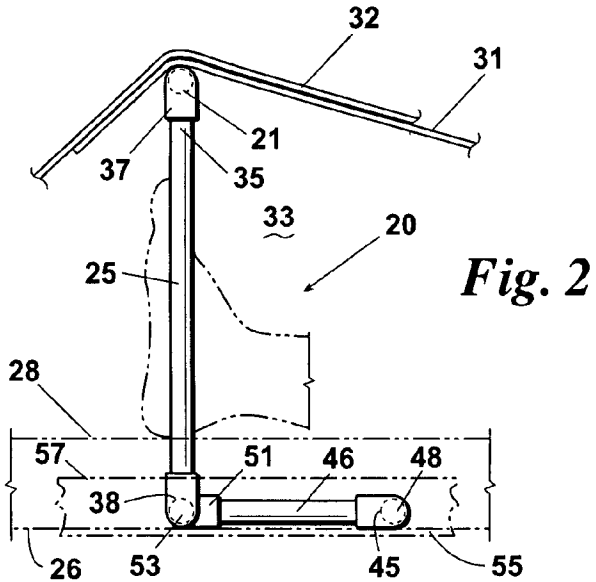
FIG. 2 is a side elevation view of the bedclothes support assembly of FIG. 1.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Looking at FIGS. 1, 4, 7, 10 and 14, several embodiments 20, 60, 70, 90 and 100 of the bedclothes support assembly are illustrated. Each of the embodiments 20, 60, 70, 90 and 100 has an upper horizontal member 21 with its ends 22 and 23 supported by a pair of upright members 24 and 25. The length of the upper horizontal member 21 is equal to or greater than the width 27 of a mattress 28 so that the mattress 28 fits between the upright members 24 and 25.

As shown in FIGS. 2, 5, 8, 11 and 15, the upper horizontal member 21 is supported above the mattress 28 at an elevation substantially higher than the uppermost point of the protected part of the anatomy of the patient. The bedcovers 30, as shown including linens 31 and a blanket 32, extend over the upper horizontal member 21 so as to create a cavity 33 around the protected part of the anatomy. The support provided by the upright members 24 and 25 at the ends 22 and 23 of the horizontal member 21 assures that both ends 22 and 23 will be maintained at the desired elevation. The upper horizontal member 21 and the upright members 24 and 25 are further sufficiently rigid so as to substantially prevent deflection of these members 21, 24 and 25 under the weight of the bedcovers 30. The bedcovers 30 will not tend to shift toward either end 22 or 23 of the upper horizontal member 21 because neither end 22 or 23 can drop below the other end 23 or 22. The bedcovers 30 will not tend to shift toward the center of the upper horizontal member 21 because it is sufficiently rigid to resist sagging. Therefore, absent application of some exterior force to the bedcovers 30 or to the support assemblies 20, 50, 70, 90 and 100, the integrity of the cavity 33 will be secure provided the upright members 24 and 25 are adequately supported.

The upper horizontal member 21 and upright members 24 and 25 may be of any material and cross-section provided the rigidity and cavity requirements above mentioned are satisfied. However, as best seen in FIGS. 1, 4, 7, 10 and 14, it is preferred that the upper horizontal member 21 and the upright members 24 and 25 be made of ¾ inch PVC pipe with the upper ends 34 and 35 of the upright members 24 and 25 connected to the ends 22 and 23 of the horizontal member 21 by ninety degree elbows 36 and 37, also preferably made of PVC plastic. An upper horizontal member 21 approximately 36 to 38 inches long will extend across most single bed mattresses. An upper horizontal member 21 approximately 54–56 inches long will extend across most double bed mattresses. Upright members 24 and 25 approximately 20 to 24 inches long will hold the bedcovers 30 sufficiently above the bottom surface 29 of the mattress 28 or the top surface of the bed frame 29 to provide a sufficient elevation for the cavity 33 to accommodate any part of the patient's anatomy.

Figure 3:
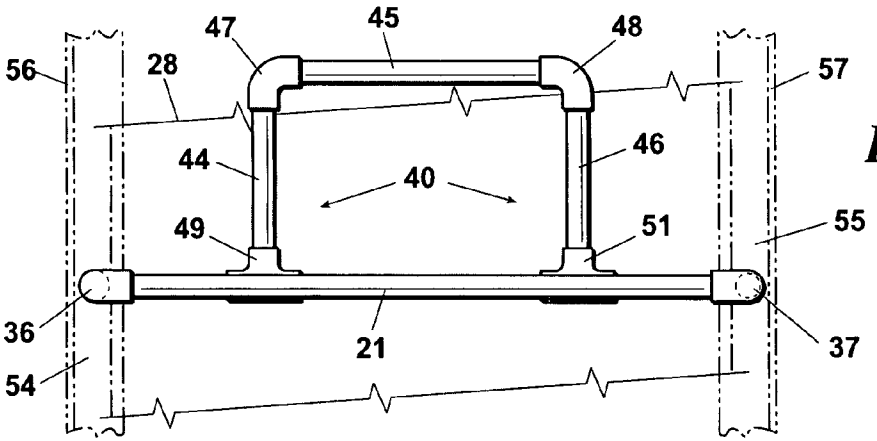
FIG. 3 is a top plan view of the bedclothes support assembly of FIG. 1.
Figure 1:
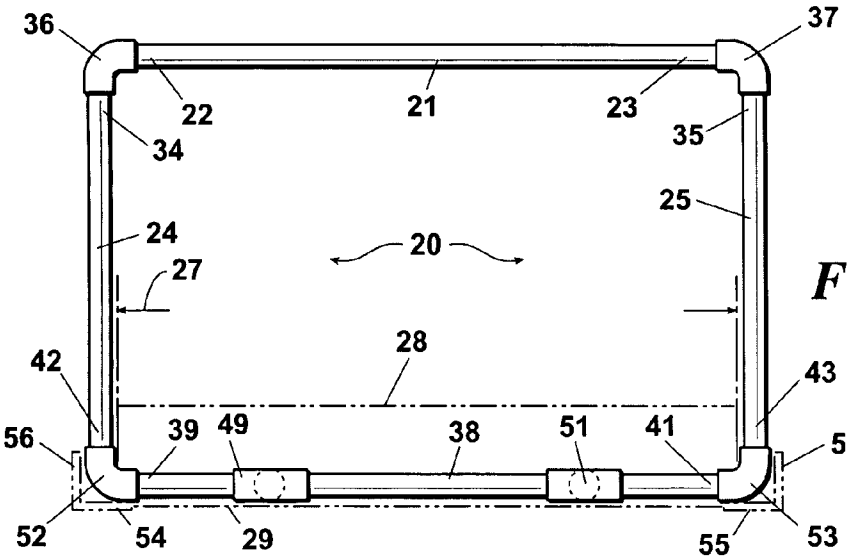
FIG. 1 is a front elevation view of a first embodiment of the bedclothes support assembly.

In the embodiment 20 of the bedclothes support assembly illustrated in FIGS. 1, 2 and 3, the upright members 24 and 25 are supported in their vertical condition by a horizontally planar base 40. The base 40 shown in FIGS. 1, 2 and 3 extends from a lower horizontal member 38 having ends 39 and 41 attached between the lower ends 42 and 43 of the upright members 24 and 25. The planar base 40 functions like a tongue sandwiched between and abutting the bottom surface 26 of the mattress 28 and the top surface of the bed frame 29. It should be noted, by reference to FIG. 2, that this embodiment 20 of the bedclothes support assembly is free-standing. That is, when placed on a horizontal surface, the assembly will remain in its upright condition and is not reliant upon any external structures to remain in the upright condition. Sandwiching the base 40 between the crosswires of the bed frame 29 and the bottom surface 26 of the mattress 28 locks the bedclothes support assembly 20 in its vertical upright condition. The base 40 can be made of any material and cross-section provided the free-standing capability of the assembly 20 is not compromised. Preferably, it consists of three tubular members 44, 45 and 46 connected to each other by ninety degree elbows 47 and 48 and connected to the lower horizontal member 38 by T-junctions 49 and 51. Most preferably, the base 40 is formed from ¾ inch PVC pipe connected by PVC elbows and T-junctions and the ends 39 and 41 of the lower horizontal member 38 are connected to the lower ends 42 and 43 of the upright members 24 and 25 by ninety degree elbows 52 and 53 of PVC plastic. As shown, using ¾ inch PVC pipe, the elbows 52 and 53 can be seated on the horizontal flanges 54 and 55 and between the vertical flanges 56 and 57 of the bed frame 29.

Figure 6:
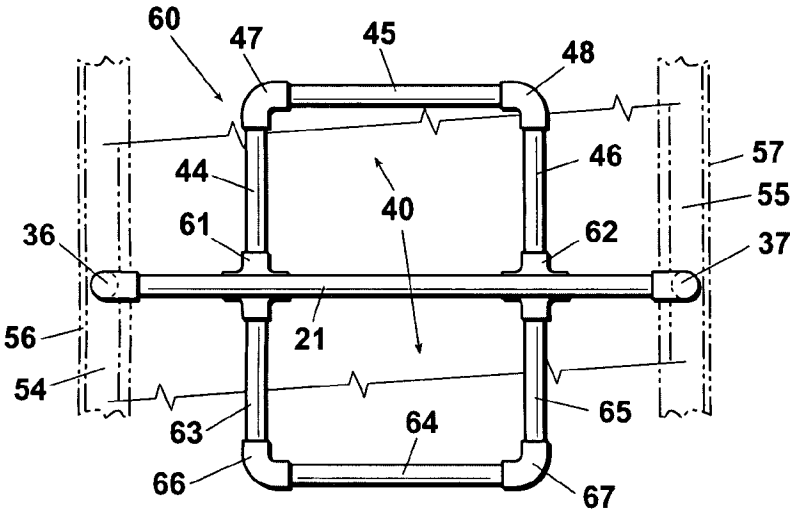
FIG. 6 is a top plan view of the bedclothes support assembly of FIG. 4.
Figure 5:
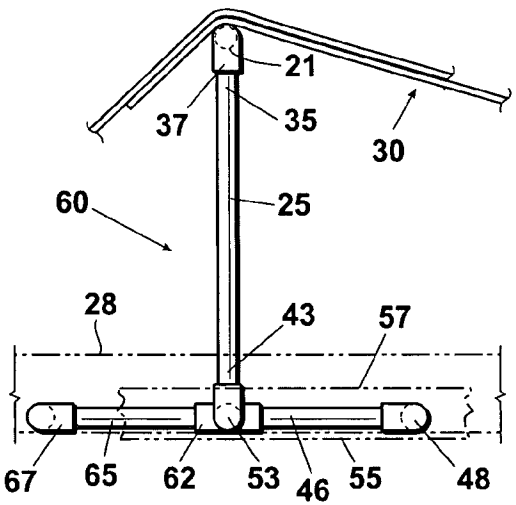
FIG. 5 is a side elevation view of a second embodiment of the bedclothes support assembly of FIG. 4.
Figure 4:
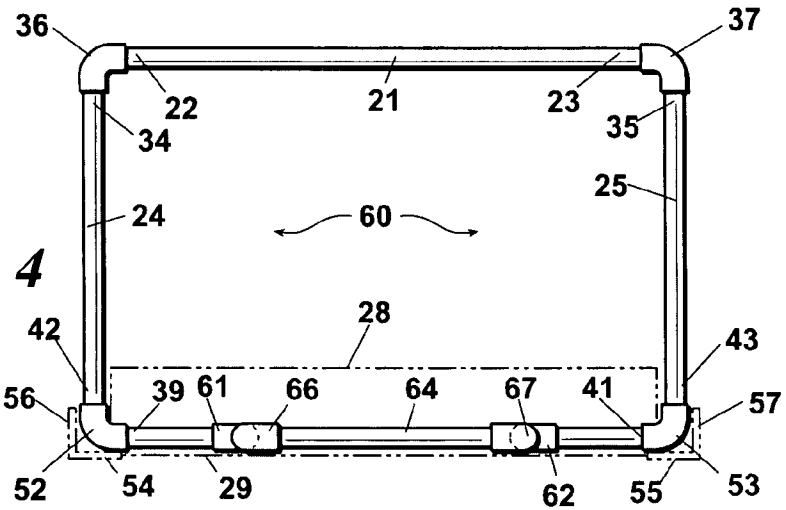
FIG. 4 is a front elevation view of a second embodiment of the bedclothes support assembly.

A second embodiment 60, illustrated in FIGS. 4, 5 and 6, is substantially identical in all respects to the embodiment 20 illustrated in FIGS. 1, 2 and 3 except that the base 40 extends both forwardly and rearwardly of the lower horizontal member 38 so as to provide additional stability to the free-standing capability of the bedclothes support assembly 60. As best seen in FIG. 6, this can be accomplished by replacing the T-junctions 49 and 51 illustrated in FIG. 3 with four-way junctions 61 and 62. Additional members 62, 63 and 64 are connected to each other with ninety degree elbows 65 and 66 and the ends of this assembly are connected to the four-way junctions 61 and 62.

Figure 8:
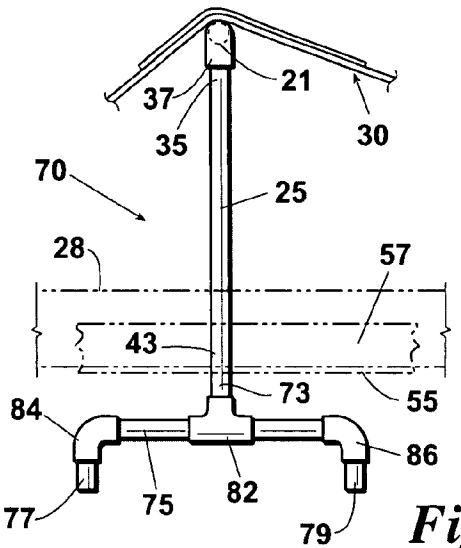
FIG. 8 is a side elevation view of the bedclothes support assembly of FIG. 7.
Figure 9:
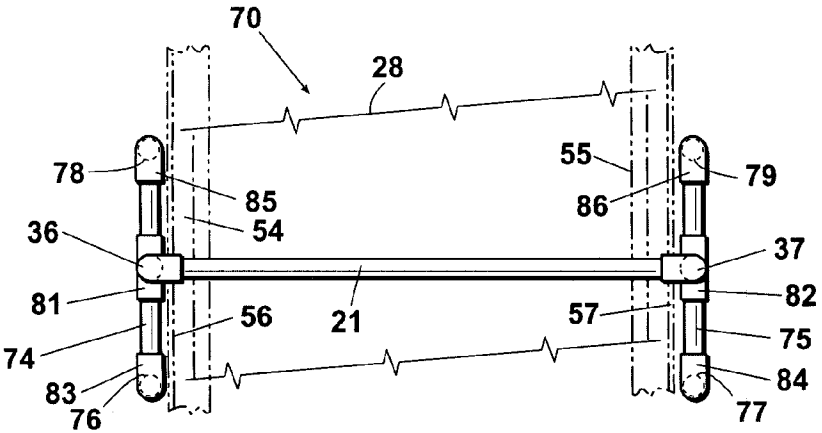
FIG. 9 is a top plan view of the bedclothes support assembly of FIG. 7.
Figure 7:
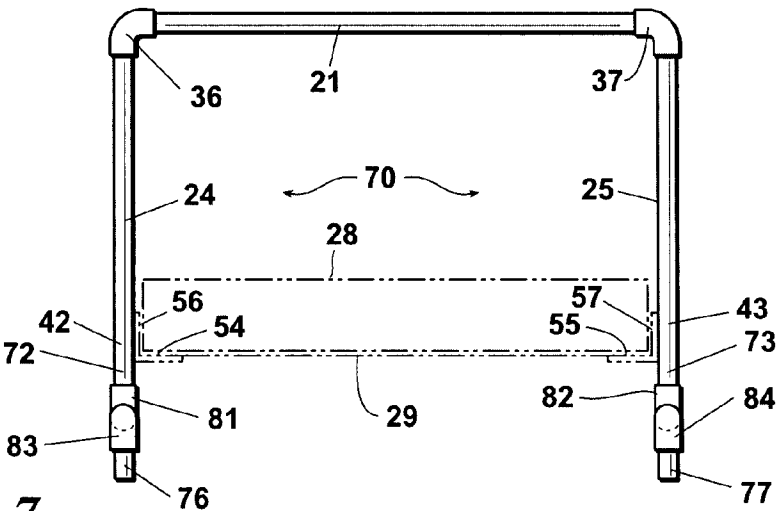
FIG. 7 is a front elevation view of a third embodiment of the bedclothes support assembly.

In a third embodiment 70 illustrated in FIGS. 7, 8 and 9, floor-mounted bases support the uprights 24 and 25 in their upright condition. In the preferred configuration shown, the lower ends 42 and 43 of the upright members 24 and 25 have downward extensions 72 and 73 terminating at horizontal cross-members 74 and 75 which may rest directly on the floor or may be supported above the floor by vertical legs 76 and 78 and 77 and 79. As shown, the cross members 74 and 75 are connected to the downward extensions 72 and 73 of the upright members 24 and 25 by T-junctions 81 and 82 and the legs 76 and 78 and 77 and 79 are connected to the cross members 74 and 75 by ninety degree elbows 83 and 85 and 84 and 86. The bases can be made of any material and cross-section provided the free-standing capability of the embodiment 70 is not compromised. Preferably, the components are made of ¾ inch PVC pipe and compatible PVC elbows and T-junctions. Cross-members 74 and 75 having a length or a distance between legs 76 and 78 and 77 and 79 of approximately 9 inches and upright extensions 72 and 73 and legs 76, 77, 78 and 79 having a combined length of approximately 12 inches have been found to perform satisfactorily.

Figure 13:
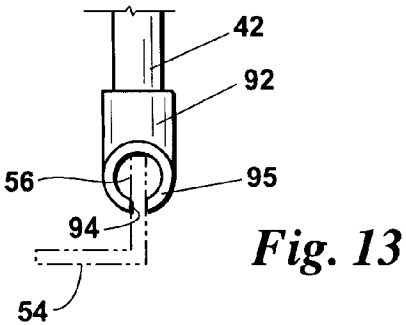
FIG. 13 is a front elevation view of the mounting bracket of the bedclothes assembly of FIG. 10.
Figure 11:
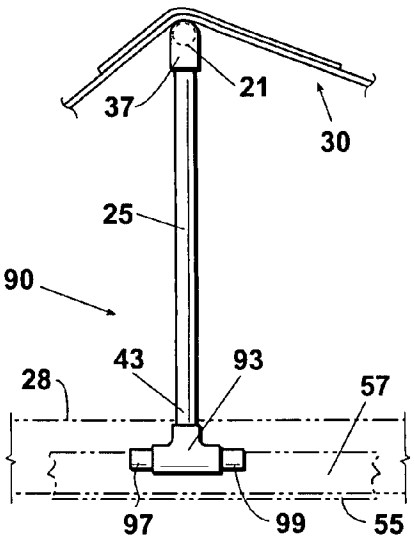
FIG. 11 is a side elevation view of the bedclothes support assembly of FIG. 10.
Figure 12:
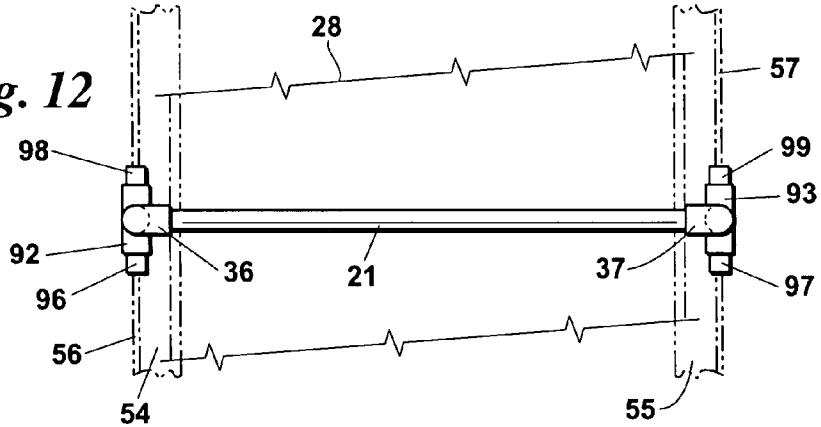
FIG. 12 is a top plan view of the bedclothes support assembly of FIG. 10.
Figure 10:
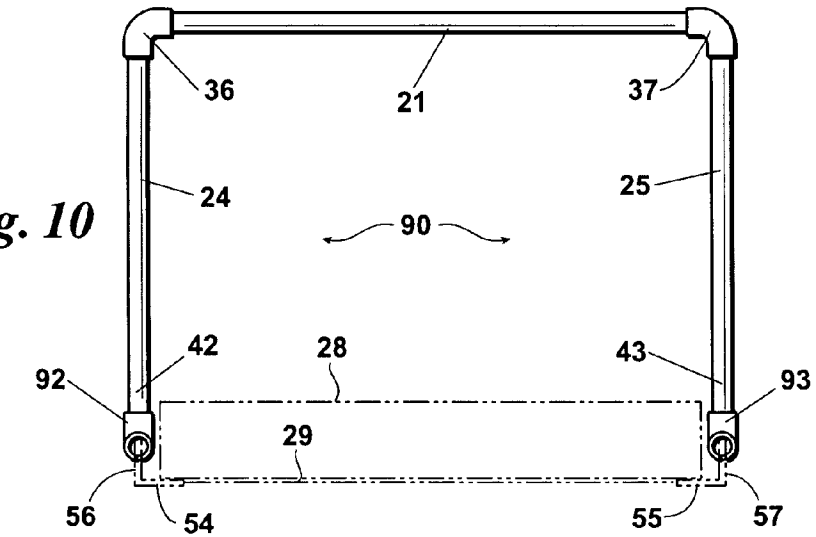
FIG. 10 is a front elevation view of a fourth embodiment of the bedclothes support assembly.

In a fourth embodiment 90 illustrated in FIGS. 10–13, two bed frame mounted bases support the uprights 24 and 25 in their upright condition. In the configuration shown, the lower ends 42 and 43 of the upright members 24 and 25 are connected to cross members 92 and 93 which extend horizontally and in substantially transverse relationship to the upper horizontal member 21. As best seen in FIG. 13, the cross-member 92 has a lengthwise slot 94 which is horizontally radially disposed through the lower wall of a tubular portion 95 of the cross-member 92. The vertical flange 56 extends into the slot 94 as the cross member 92 is seated on the horizontal flange 54 of the bed frame 29. The tubular member 95 need not necessarily be round or hollow so long as the slot can receive the vertical flange 56. The cross member 93 is identical to the cross member 92 illustrated in FIG. 13. The cross members 92 and 93 may be of any material in cross section provided the free-standing capability of the embodiment 90 is not compromised. Preferably, the cross members 92 and 93 are T-junctions having a horizontal length of approximately three inches or more and are made of PVC plastic. As shown, the T junctions can be extended by use of additional sections of PVC pipe 96 and 98 and 97 and 99 having slots in their lower walls aligned with the slots 94 in the T-junctions 92 and 93. Again, the bases can be made of any material in cross section provided the free-standing capability of the embodiment 90 is not compromised.

Figure 17:
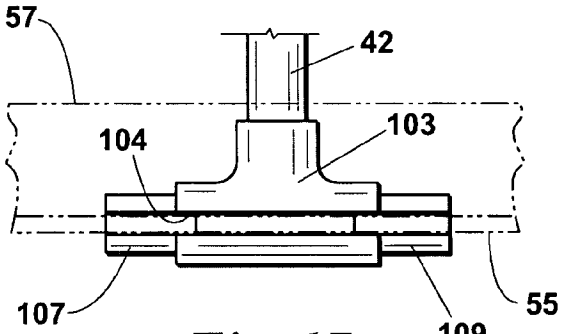
FIG. 17 is a front elevation view of the mounting bracket of the bedclothes assembly of FIG. 14.
Figure 15:
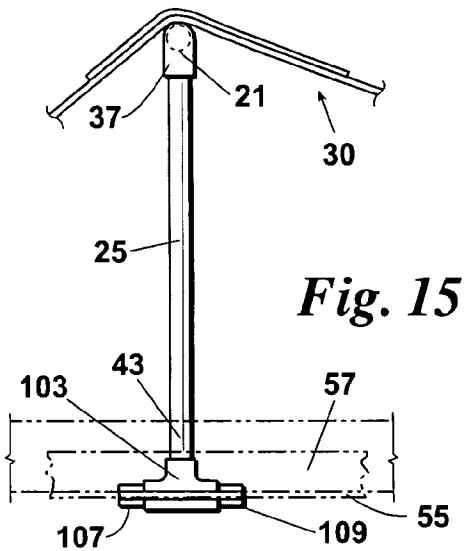
FIG. 15 is a side elevation view of the bedclothes support assembly of FIG. 13.
Figure 16:
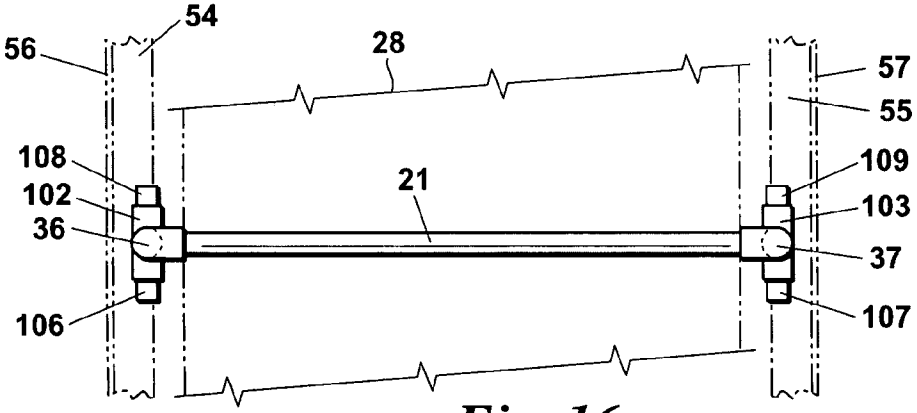
FIG. 16 is a top plan view of the bedclothes support assembly of FIG. 13.
Figure 14:
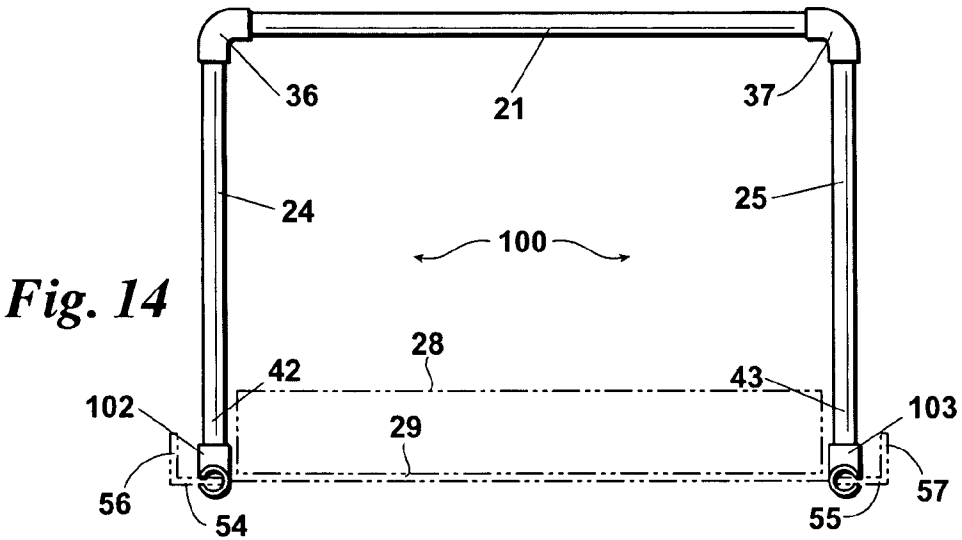
FIG. 14 is a front elevation view of a fifth embodiment of the bedclothes support assembly.

In a fifth embodiment 100 illustrated in FIGS. 14–17, bed frame mounted bases support the uprights 24 and 25 in their upright condition. The embodiment 100 is in all respects the same as the fourth embodiment illustrated in FIGS. 10–13 except that the cross-members 102 and 103 have lengthwise slots 104 which are through a horizontally radial side wall of the cross members 102 and 103. Thus, the cross members 102 and 103 can be engaged on the horizontal flanges 54 and 55 by insertion of the inside edges of the horizontal flanges 54 and 55 into the slots 104 of their respective cross members 92 and 93. As best seen in FIG. 17, the horizontal length of the cross members 92 and 93 can be extended by use of additional segments of pipe 106 and 108 and 107 and 109 which can be added to their respective cross members 92 and 93.

The various embodiments of the bedclothes support assembly herein illustrated and described have been generally dimensioned to accommodate a single bed. However, the bedclothes support assembly can be used with any size bed, from single to king size, with appropriate variations in the width of the assembly.

Thus, it is apparent that there has been provided, in accordance with the invention, a bedclothes support assembly that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For maintaining bedclothes in an elevated condition to protect a selected anatomical structure of a person on a bed, an assembly comprising an upper horizontal member of unadjustable length at least equal to a width of a mattress of the bed, a pair of upright members of equal unadjustable height greater than a distance from a lower surface of the mattress to an uppermost point of the selected anatomical structure to be protected, an upper end of each of said upright members being attached to an end of said upper horizontal member, and a horizontally planar base rigidly fixed to and between said lower ends of said upright members for cooperable abutment against the lower surface of the mattress to support said upright members in an unadjustable vertical relationship.

2. An assembly according to claim 1, said planar base comprising a lower horizontal member rigidly fixed between said lower ends of said upright members and a horizontal tongue rigidly fixed to and extending from said lower horizontal member.

3. An assembly according to claim 2, said tongue extending forwardly and rearwardly from said lower horizontal member.

4. For maintaining bedclothes in an elevated condition to protect a selected anatomical structure of a person on a bed, an assembly comprising an upper horizontal member of length at least equal to a width of a mattress of the bed, a pair of upright members of equal height greater than a distance from a lower surface of the mattress to an uppermost point of the selected anatomical structure to be protected, an upper end of each of said upright members being attached to an end of said upper horizontal member, and a pair of tubular cross-members, each said tubular cross-member being substantially transverse to said upper horizontal member and fixed to a lower end of its respective said upright member, each said cross-member having a lengthwise slot in a wall thereof for engagement on the frame of the bed to support lower ends of each of said upright members at a same elevation at least equal to an elevation of the lower surface of the mattress.

5. An assembly according to claim 4, said slot being vertically radially disposed in a lower segment of said tubular member for engagement on a vertical flange of the frame.

6. For maintaining bedclothes in an elevated condition to protect a selected anatomical structure of a person on a bed, an assembly comprising an upper horizontal member of length at least equal to a width of a mattress of the bed, a pair of upright members of equal height greater than a distance from a lower surface of the mattress to an uppermost point of the selected anatomical structure to be protected, an upper end of each of said upright members being attached to an end of said upper horizontal member, and a pair of tubular members, each said tubular cross member being substantially transverse to said upper horizontal member and fixed to a lower end of the respective said upright member, each said cross member having a lengthwise slot horizontally radially disposed in an outer segment of a wall of said tubular member for engagement on a horizontal flange of the frame to support lower ends of each of said upright members at a same elevation at least equal to an elevation of the lower surface of the mattress.

7. A combination comprising a mattress supported by a bed frame, bedclothes over said mattress and an assembly for maintaining said bedclothes in an elevated condition to protect a selected anatomical structure of a person on said bed, said assembly comprising an upper horizontal member of unadjustable length at least equal to a width of said mattress, a pair of upright members of equal unadjustable height greater than a distance from a lower surface of said mattress to an uppermost point of the selected anatomical structure to be protected, an upper end of each of said upright members being attached to an end of said upper horizontal member, and a horizontally planar base rigidly fixed to and between said lower ends of said upright members for cooperable abutment against said lower surface of said mattress to support said upright members in an unadjustable vertical relationship.

8. An assembly according to claim 7, said planar base comprising a lower horizontal member rigidly fixed between said lower ends of said upright members and a horizontal tongue rigidly fixed to and extending from said lower horizontal member.

9. An assembly according to claim 8, said tongue extending forwardly and rearwardly from said lower horizontal member.

10. A combination comprising a mattress supported by a bed frame, bedclothes over said mattress and an assembly for maintaining said bedclothes in an elevated condition to protect a selected anatomical structure of a person on said bed, said assembly comprising an upper horizontal member of length at least equal to a width of said mattress, a pair of upright members of equal height greater than a distance from a lower surface of said mattress to an uppermost point of the selected anatomical structure to be protected, an upper end of each of said upright members being attached to an end of said upper horizontal member, and a pair of tubular cross-members, each said tubular cross-member being substantially transverse to said upper horizontal member and fixed to a lower end of its respective said upright member, each said cross-member having a lengthwise slot in a wall thereof for engagement on said frame of said bed to support lower ends of each of said upright members at a same elevation at least equal to an elevation of said lower surface of said mattress.

11. An assembly according to claim 10, said slot being vertically radially disposed in a lower segment of said tubular member for engagement on a vertical flange of said frame.

12. A combination comprising a mattress supported by a bed frame, bedclothes over said mattress and an assembly for maintaining said bedclothes in an elevated condition to protect a selected anatomical structure of a person on said bed, said assembly comprising an upper horizontal member of length at least equal to a width of said mattress, a pair of upright members of equal height greater than a distance from a lower surface of said mattress to an uppermost point of the selected anatomical structure to be protected, an upper end of each of said upright members being attached to an end of said upper horizontal member, and a pair of tubular members, each said tubular cover member being substantially transverse to said upper horizontal member and fixed to a lower end of its respective said upright member, each said cross member having a lengthwise slot horizontally radially disposed in an outer segment of a wall of said tubular member for engagement on a horizontal flange of said frame to support lower ends of each of said upright members at a same elevation at least equal to an elevation of said lower surface of said mattress.

* * * * *